US006261020B1

(12) United States Patent
Wyant

(10) Patent No.: US 6,261,020 B1
(45) Date of Patent: Jul. 17, 2001

(54) BINDER WITH HOLE PUNCH

(75) Inventor: Jon R. Wyant, Centerville, OH (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/617,561

(22) Filed: Jul. 17, 2000

Related U.S. Application Data

(63) Continuation-in-part of application No. 09/488,599, filed on Jan. 20, 2000.

(51) Int. Cl.[7] ..... B42F 13/40
(52) U.S. Cl. ..... 402/1; 402/4; 83/167
(58) Field of Search ..... 402/1, 4, 80 R, 402/80 L; 281/37, 51; 83/597, 605, 167; 30/358, 360

(56) References Cited

U.S. PATENT DOCUMENTS

| | | | | |
|---|---|---|---|---|
| 436,048 | | 9/1890 | Valiquet . | |
| 606,508 | | 6/1898 | Boykin . | |
| 1,142,032 | | 6/1915 | Faifer . | |
| 1,218,849 | | 3/1917 | Frederickson . | |
| 1,285,048 | | 11/1918 | Cooke, Jr. . | |
| 1,336,998 | | 4/1920 | Bottle . | |
| 1,726,219 | | 8/1929 | Gammeter . | |
| 2,139,159 | | 12/1938 | Hammen | 129/7 |
| 2,318,192 | | 5/1943 | Boelema, Jr. | 281/31 |
| 2,370,319 | | 2/1945 | Lippincott | 164/124 |
| 2,445,440 | * | 7/1948 | Klemm | 402/1 X |
| 3,172,325 | | 3/1965 | Wernham et al. | 83/599 |
| 3,595,554 | | 7/1971 | Donovan | 269/2 |
| 3,975,105 | | 8/1976 | Cline | 402/1 |
| 4,729,688 | | 3/1988 | Manz | 402/1 |
| 4,743,048 | | 5/1988 | Gruswith, III | 281/21 R |
| 4,749,297 | | 6/1988 | Roy | 402/1 |
| 4,961,596 | | 10/1990 | Moor | 281/15.1 |
| 5,005,458 | | 4/1991 | Merrick | 83/599 |
| 5,058,736 | | 10/1991 | Bedol | 206/214 |
| 5,209,592 | | 5/1993 | Bedol | 402/1 |
| 5,273,370 | | 12/1993 | Bland et al. | 402/1 |
| 5,291,813 | | 3/1994 | Blumenthal et al. | 83/599 |
| 5,340,229 | | 8/1994 | Schwartzman | 402/4 |
| 5,403,108 | * | 4/1995 | Karlis | 402/1 |
| 5,409,319 | | 4/1995 | Bedol | 402/1 |
| 5,429,445 | | 7/1995 | Un-tae | 402/1 |
| 5,490,440 | | 2/1996 | Karlis et al. | 83/599 |
| 5,501,128 | | 3/1996 | D'Amore | 83/599 |
| 5,503,052 | | 4/1996 | Rigney et al. | 83/467.1 |
| 5,553,958 | * | 9/1996 | Bedol | 402/1 |
| 5,839,843 | | 11/1998 | Bedol | 402/4 |
| 5,845,407 | | 12/1998 | Cerrato | 30/459 |
| 5,906,448 | * | 5/1999 | Najmi | 402/1 |

* cited by examiner

*Primary Examiner*—Willmon Fridie, Jr.
(74) *Attorney, Agent, or Firm*—Thompson Hine & Flory LLP

(57) ABSTRACT

A binder for receiving and retaining loose leaf papers including a cover, a binding mechanism coupled to the cover, and a hole punch mechanism coupled to the cover. The hole punch mechanism includes a base and a handle movable relative to the base. The handle includes a set of protrusions and the base includes a set of openings aligned with the protrusions such that each protrusion can be received in a corresponding opening to punch a hole in a sheet of paper. The base includes a top portion and a bottom portion forming a cavity therebetween for receiving the punched holes. The top portion is removable to provide access to the cavity, and the holes are formed in the top portion.

15 Claims, 3 Drawing Sheets

BINDER WITH HOLE PUNCH

This application is a continuation-in-part of U.S. Ser. No. 09/488,599, filed Jan. 20, 2000.

The present invention is directed to a binder having a hole punch.

BACKGROUND OF THE INVENTION

Binders are used by students and professionals to store loose leaf papers and other loose items. The binders typically include a binding mechanism, such as a conventional three ring binder, to bind the papers together. However, many papers, such as hand-outs, photocopies, large or irregular-sized papers, and the like do not have pre-punched holes. In these cases, holes must be punched in the papers using a hole punch mechanism before the papers can be received in the binder. However, a hole punch may not always be readily available, and it can be difficult to predict when a hole punch may be needed. Furthermore, standard hole punches can be quite bulky and heavy, and therefore inconvenient to carry. Accordingly, there is a need for a binder that can form holes into a paper such that the papers can be received in the binding mechanism of the binder.

SUMMARY OF THE INVENTION

The present invention is a binder having a hole punch mechanism. The hole punch is preferably mounted to the cover of the binder, and is configured to punch holes in a piece of paper such that the punched paper can be received in the binding mechanism of the binder. The present invention eliminates the need to carry a separate hole punch, and ensures that a hole punch mechanism is available whenever unpunched papers are desired to be placed into the binder.

In one embodiment, the invention is a binder for receiving and retaining loose leaf papers including a cover, a binding mechanism coupled to the cover, and a hole punch mechanism coupled to the cover. The hole punch mechanism includes a base and a handle movable relative to the base. The handle includes a set of protrusions and the base includes a set of openings aligned with the protrusions such that each protrusion can be received in a corresponding opening to punch a hole in a sheet of paper. The base includes a top portion and a bottom portion forming a cavity therebetween for receiving the punched holes. The top portion is removable to provide access to the cavity, and the holes are formed in the top portion.

Other objects and advantages of the present invention will be apparent from the following description and the accompanying drawings.

DETAILED DESCRIPTION

Figure 1:
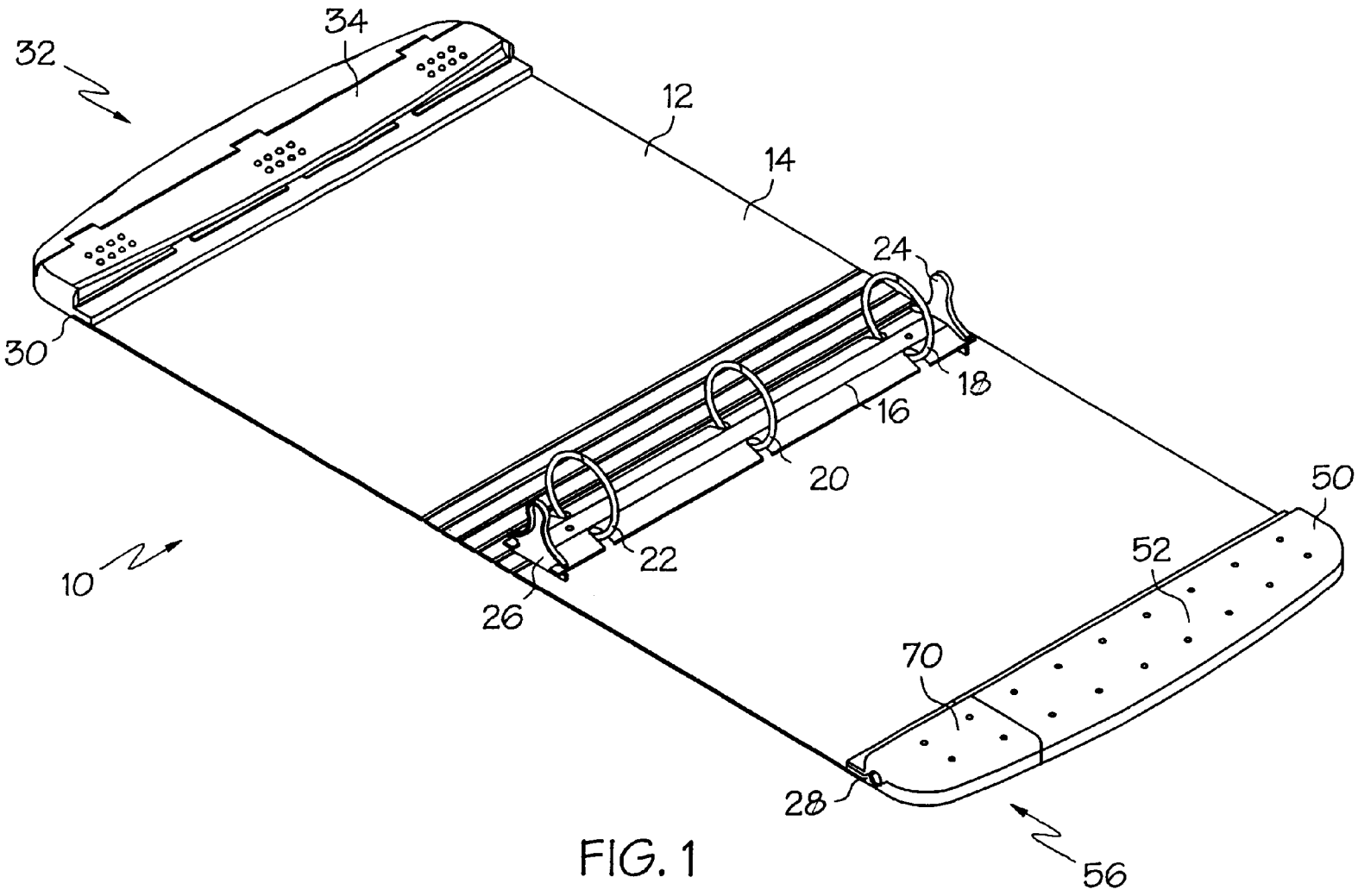
FIG. 1 is a top view of the binder of the present invention, with the hole punch, receptacle and pencil sharpener in their closed positions.

As shown in FIG. 1, the binder 10 of the present invention includes a cover 12 having an inner surface 14 and a binding mechanism 16 coupled to the inner surface of the cover. The binding mechanism 16 is shown as a conventional three ring binder, although a variety of binding mechanisms may be used without departing from the scope of the present invention. The illustrated binding mechanism 16 includes a set of openable rings 18, 20, 22 that are actuable by a set of triggers 24, 26. The rings 18, 20, 22 are preferably generally evenly spaced apart a distance of about 4¼ inches.

Figure 2:
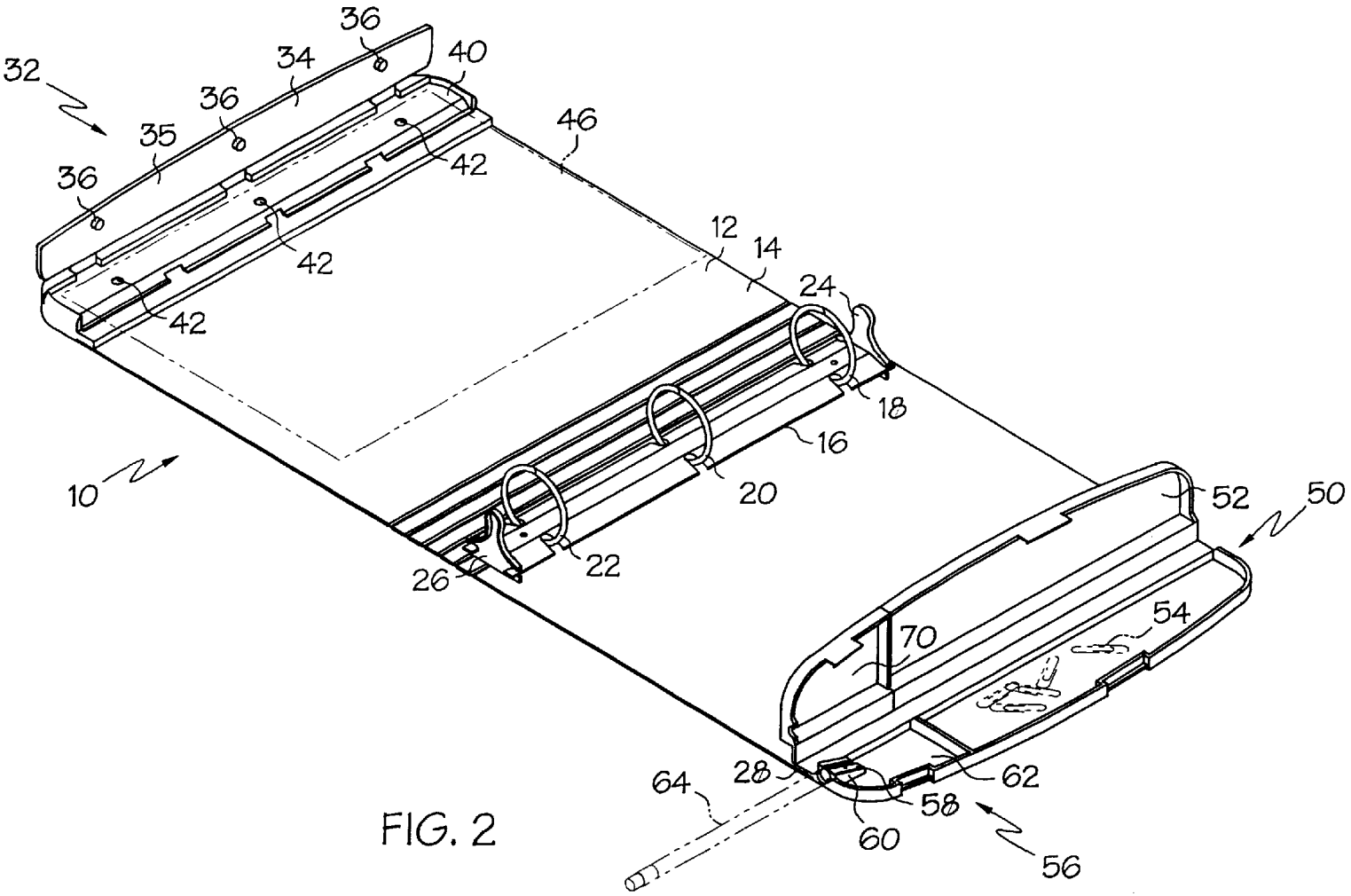
FIG. 2 is a top view of the binder of FIG. 1, with the hole punch, receptacle and pencil sharpener in their open positions.

The cover 12 includes a pair of opposed outer side edges 28, 30, and a hole punch 32 is located adjacent the outer edge 30. The hole punch 32 includes a movable handle 34 having a set of protrusions 36 on the lower surface 35 of the handle 34 (FIG. 2). The hole punch 32 also includes a base 40 having a set of openings 42 that are aligned with the protrusions 36. In order to punch a hole in a sheet of paper 46, the handle 34 is moved to its open position, as shown in FIG. 2 by pivoting the handle 34 away from the binding mechanism 16. A paper 46 is then slid on top of the base 40 such that the paper is located between the handle 34 and the base 40. The handle 34 is then moved to the closed position by pivoting the handle towards the binding mechanism 16 such that the protrusions 36 are received in a respective opening 42, thereby punching a set of holes in the paper 46. When the hole punch 32 is in its closed position, the hole punch is in its compact, "storage" arrangement, and the hole punch is normally located in this position. The handle 34 is located adjacent the base 40, and the binder can be moved to its closed position such that the opposed side edges 28, 30 are located adjacent each other. The handle 34 and base 40 are preferably made of a light weight plastic material, such as acrylonitrile butadiene styrene (ABS) to provide a light weight hole punch 32.

The protrusions 36 and openings 42 are preferably aligned such that the hole punch 32 forms a set of holes in the paper 46 that correspond to the spacing of the rings 18, 20, 22. In this manner, a sheet of paper punched with the hole punch 32 can be received in the binding mechanism 16. Of course, various other holes punches besides the hole punch 32 shown herein may be used without departing from the scope of the present invention. For example, the protrusions 36 may be located on the base 40 and the openings 42 may be located on the handle 34. Furthermore, many other mechanisms beyond cooperating protrusions and openings may be used as a hole punch mechanism. Preferably the hole punch 32 is configured to punch holes in a sheet of paper 46 such that the binding mechanism 16 can pass through the holes to receive and retain the paper in the binder 10. Further preferably the hole punch 32 forms the requisite holes in a single motion of the hole punch 32, such that multiple punchings of the paper 46 are not required.

The binder 10 further includes a receptacle 50 located adjacent the side edge 28 of the binder 10, the receptacle having a pivotable, closable lid 52. The receptacle 50 can be used to hold various loose items (such as the paper clips 54 shown in FIG. 2) in a location that is convenient to the user. The binder 10 also has a pencil sharpener 56 located adjacent the receptacle 50. The pencil sharpener 56 includes a blade 58 mounted into a blade holder 60, and has a shavings receptacle 62 adjacent the blade holder 60 to receive the shavings generated by sharpening a pencil 64. The shavings receptacle 62 includes a closable lid 70 such that the shavings in the shaving receptacle 62 can periodically be emptied.

The pencil sharpener 56 and the receptacle 50 are located along the edge 28 of the cover 12. As shown in FIG. 1, when in the closed position the pencil sharpener 56 and receptacle 50 form a shape along the edge 28 that is similar to the shape of the hole punch 32 (in its closed position) along the edge 30. Furthermore, when the binder 10 is in a closed configuration, the handle 34 of the hole punch 32 engages lid 52 of the receptacle and the lid 70 of the pencil sharpener 56, which helps to maintain the alignment of, and prevent excess bending of, the cover 12 of the binder 10.

Figure 3:
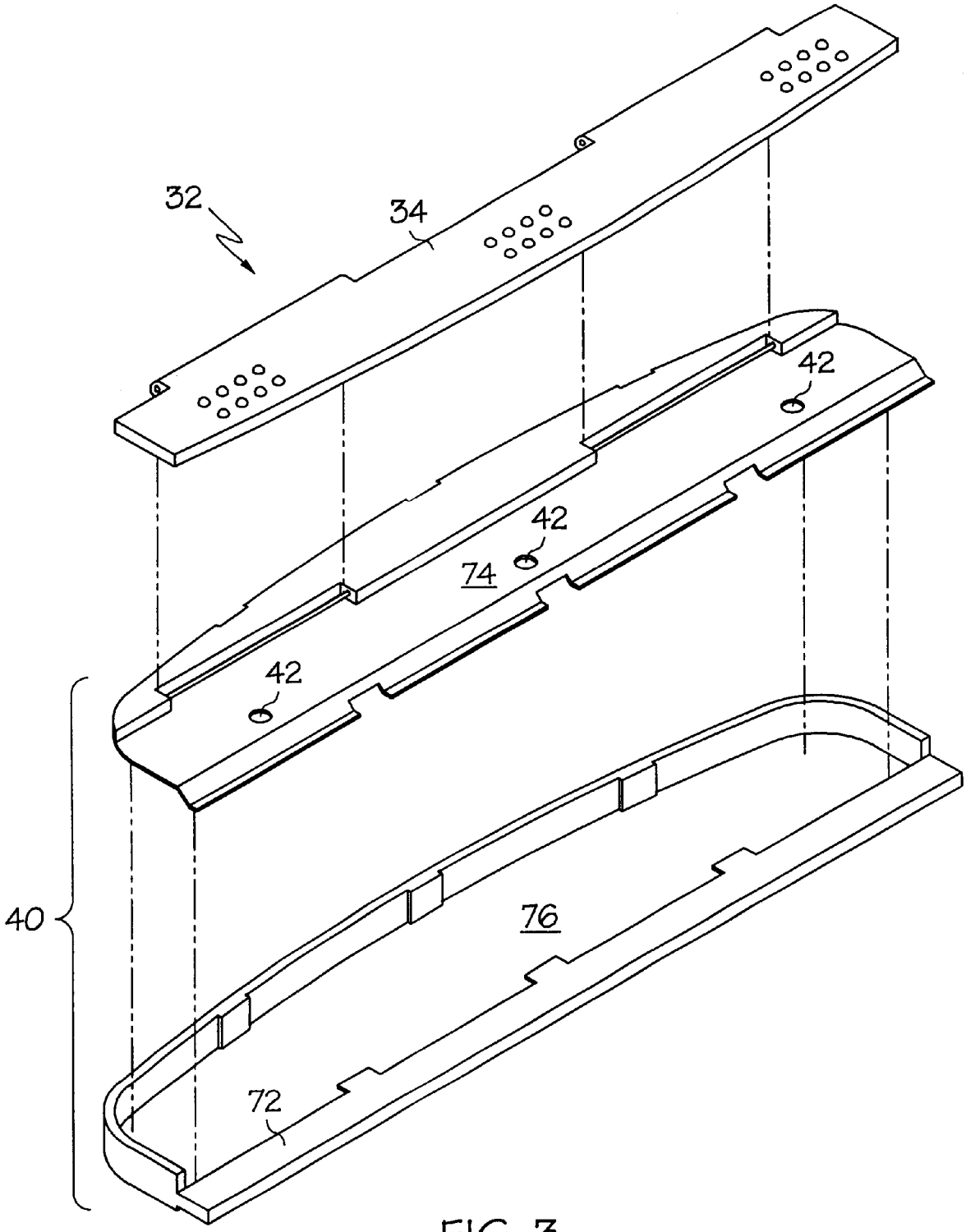
FIG. 3 is an exploded view of the hole punch of FIGS. 1 and 2.

As shown in FIG. 3, the base 40 includes a receptacle or bottom portion 72 which receives a carrier or top portion 74 therein. The carrier 74 includes the openings 42, and can be received in the receptacle 72 by an interference fit, snap fit, or other attachment methods. A cavity 76 is defined between the receptacle 72 and the carrier 74 when the base 40 is assembled, and the holes that are punched in a piece of paper by the handle 34 are received in the cavity 76. When the cavity 76 is desired to be emptied, the carrier 74 is snapped out of place from the receptacle, which exposes the cavity and enables the carrier to be emptied. In an alternate embodiment, the bottom portion of the cavity 76 may be formed by the cover of the binder.

The orientation of the protrusions 36 and openings 42 may be reversed such that the protrusions are located on the base 40 and the openings 42 are located on the handle 34. However, in this case the handle 34 preferably includes the cavity (not shown) to receive the punched holes. In this embodiment the handle may include a top portion and a bottom portion forming a cavity therebetween, and one or both of the top and bottom portions may be removable to provide access to the cavity.

Having described the invention in detail and by reference to the preferred embodiments, it will be apparent that modifications and variations thereof are possible without departing from the scope of the invention.

What is claimed is:

1. A binder for receiving and retaining loose leaf papers comprising:

a cover;

a binding mechanism coupled to said cover; and a hole punch mechanism coupled to said cover, said hole punch mechanism including a base and a handle movable relative to said base, said handle including a set of protrusions, said base including a set of openings aligned with said protrusions such that each protrusion can be received in a corresponding opening to punch a hole in a sheet of paper, said base including a top portion and a bottom portion forming a cavity therebetween for receiving said punched holes, said top portion being removable to provide access to said cavity, and wherein said holes are formed in said top portion.

2. The binder of claim 1 wherein said bottom portion is coupled to said cover.

3. The binder of claim 2 wherein said top portion is coupled to said bottom portion by an interference fit.

4. The binder of claim 1 wherein said bottom portion is formed by said cover.

5. The binder of claim 1 wherein said hole punch mechanism is configured to punch a set of holes in a sheet of paper such that said binding mechanism can be received through said set of holes to receive and retain said paper in said binder.

6. The binder of claim 5 wherein said binding mechanism includes a three binding rings having a predetermined spacing pattern, and wherein said hole punch mechanism is configured to punch three holes in a sheet of paper having a spacing that corresponds to said predetermined spacing of said binding rings.

7. The binder of claim 6 wherein said hole punch mechanism can be operated in a single manual motion to punch holes in said sheet that correspond to said predetermined spacing pattern.

8. The binder of claim 5 wherein said handle pivots towards said binding mechanism when said handle punches a hole in said sheet of paper.

9. The binder of claim 1 wherein said cover includes a pair of opposed side edges, and wherein said hole punch is located adjacent one of said side edges.

10. The binder of claim 1 further comprising a pencil sharpener coupled to said cover.

11. The binder of claim 9 further comprising a receptacle having a closable lid coupled to said cover.

12. The binder of claim 10 wherein said cover includes an outer surface, an inner surface, and a pair of opposed side edges, and wherein said hole punch is located on said inner surface adjacent one of said side edges, and wherein said pencil sharpener and said receptacle are located on said inner surface adjacent the other side edge.

13. The binder of claim 1 wherein said hole punch is configured such that said handle is stored in a position wherein said set of protrusions are received in said set of openings.

14. The binder of claim 1 wherein said handle is pivotably coupled to said base.

15. A binder for receiving and retaining loose leaf papers comprising:

a cover;

a binding mechanism coupled to said cover, and a hole punch mechanism coupled to said cover, said hole punch mechanism including a base and a handle movable relative to said base, said handle including a set of openings, said base including a set of protrusions aligned with said openings such that each protrusion can be received in a corresponding opening to punch a hole in a sheet of paper, said handle including a top portion and a bottom portion forming a cavity therebetween for receiving said punched holes, one of said top portion or bottom portion being removable to provide access to said cavity.

* * * * *